US006310028B1

(12) United States Patent
Janssen

(10) Patent No.: US 6,310,028 B1
(45) Date of Patent: Oct. 30, 2001

(54) WATER-SOFTENING AND DETERGENT COMPOSITIONS CONTAINING PARTIALLY HYDRATED NA ACETATE

(75) Inventor: Roger Joseph Anna Janssen, Vlaardingen (NL)

(73) Assignee: Unilever Home & Personal Care, USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/413,981

(22) Filed: Oct. 7, 1999

(30) Foreign Application Priority Data

Oct. 9, 1998 (GB) ..... 9822090
Aug. 5, 1999 (GB) ..... 9918504

(51) Int. Cl.[7] ..... C11D 7/02; C11D 7/10

(52) U.S. Cl. ..... 510/446; 510/141; 510/315; 510/323; 510/361; 510/377; 510/398; 510/434; 510/446; 510/477; 510/488; 510/507; 510/511

(58) Field of Search ..... 510/141, 315, 510/323, 361, 377, 398, 434, 446, 477, 488, 507, 511

(56) References Cited

U.S. PATENT DOCUMENTS

| | | | | |
|---|---|---|---|---|
| 3,953,350 | | 4/1976 | Fujino et al. | 252/94 |
| 4,219,435 | * | 8/1980 | Biard et al. | 252/90 |
| 4,756,838 | | 7/1988 | Veltman | 252/1 |
| 4,828,749 | | 5/1989 | Kruse et al. | 252/135 |

FOREIGN PATENT DOCUMENTS

| | | | |
|---|---|---|---|
| 196 37 606 | | 3/1998 | (DE) . |
| 0 000 293 | | 1/1979 | (EP) . |
| 522766 | | 1/1993 | (EP) . |
| 711 827 | | 5/1996 | (EP) . |
| 838519 | * | 4/1998 | (EP) . |
| 911204 | | 11/1962 | (GB) . |
| 06-122900 | * | 5/1994 | (JP) . |
| 90/02165 | | 3/1990 | (WO) . |
| 96/06156 | | 2/1996 | (WO) . |
| 98/42187 | | 10/1998 | (WO) . |

OTHER PUBLICATIONS

PCT International Search Report in a PCT application PCT/EP 99/07426.
Derwent Abstract of JP 7278044, Oct. 24,1995.
Derwent Abstract of DE 196 37 606, Mar. 26, 1998.

* cited by examiner

*Primary Examiner*—Yogendra N. Gupta
*Assistant Examiner*—Charles Boyer
(74) *Attorney, Agent, or Firm*—Rimma Mitelman

(57) ABSTRACT

The speed of disintegration of tablets containing a water-softening agent, especially water-insoluble, water-softening agent intended as detergency builder for fabric washing is enhanced by incorporating partially hydrated sodium acetate alone or jointly with sodium citrate dihydrate and/or crystallised sodium acetate trihydrate.

14 Claims, No Drawings

WATER-SOFTENING AND DETERGENT COMPOSITIONS CONTAINING PARTIALLY HYDRATED NA ACETATE

This invention relates to compositions in the form of tablets, containing a water-softening agent. These tablets may be embodied as detergent compositions for use in fabric washing. Another possibility is that they could be embodied as water-softening tablets, which could be used in fabric washing jointly with a composition containing detergent active, or could possibly be used in other applications, e.g. in machine dishwashing as an anti-limescale product.

Detergent compositions in tablet form have been described in a number of documents such as GB 911204 (Unilever), US 3953350 (Kao), and others subsequently. Such tablets are sold commercially. Tablets have several advantages over powdered products: they do not require measuring and are thus easier to handle and dispense into the washload, and they are more compact, hence facilitating more economical storage.

Detergent tablets are generally made by compressing or compacting a detergent powder, which includes detergent active and detergency builder. EP-A-522766 explains that difficulty has been found in providing tablets which have adequate strength when dry, yet disperse and dissolve quickly when added to wash water. The problem has proved especially difficult with compositions containing insoluble aluminosilicate as detergency builder. It is necessary to compromise between speed of disintegration at the time of use and strength during handling before use.

EP 0 838 519 discloses the use of sodium acetate trihydrate to enhance the speed of disintegration of tablets, without detriment to tablet strength.

Other disclosures relevant to sodium acetate or hydrated salts in tablets include WO 90/02165 which mentions a range of materials including sodium acetate as tableting aids, preferably used as a small percentage of the composition and preferably of fine particle size. A range of possible functions is attributed indiscriminately to these tableting aids.

EP-A-711827 teaches that speed of disintegration of tablets can be improved by including a highly water-soluble citrate.

WO 96/06156 mentions that hydrated materials are useful when making tablets with the aid of microwave radiation to cause sintering.

Sodium acetate trihydrate is normally produced by a crystallisation process, so that the crystallised product contains 3 molecules of water of crystallisation for each sodium and acetate ion pair.

We have now found that sodium acetate in partially hydrated form, for example, produced by a spray-drying or granulation route, can be used in place of crystallised material and surprisingly, it enhances the speed of disintegration of tablets without loss of strength.

Broadly, the present invention provides a tablet of a compacted particulate composition wherein the tablet or a region thereof contains a water-softening agent and the composition also includes sodium acetate which is partially hydrated.

The amount of water-softening agent will generally be at least 15% by weight of the composition. Depending on the function for which the tablets are intended the amount may range up to 90 or 93% by weight. In significant forms of this invention there is at least 15%, by weight of the composition, of a water-insoluble water softening agent.

The amount of the partially hydrated sodium acetate may be at least 5 or 7% by weight of the composition, often at least 10% or 13% by weight. It will generally not exceed 35% by weight of the composition and frequently will not exceed 25% or 30% by weight of the composition. Smaller amounts down to 2% by weight of the composition may be employed, especially in conjunction with a second material which promotes disintegration.

Accordingly, the present invention provides a tablet of a compacted particulate composition wherein the tablet or a region thereof comprises from 15 to 93% by weight of a water-softening agent characterised in that the tablet or said region thereof contains 2 to 35% by weight of partially hydrated sodium acetate.

It is possible that the partially hydrated sodium acetate might be used jointly with sodium citrate dihydrate because sodium citrate dihydrate may function as a water-soluble water softening agent/detergency builder as well as enhancing the speed of disintegration of a tablet in water.

It is also possible that the partially hydrated sodium acetate is used in conjunction with crystalline sodium acetate trihydrate, as described in EP 838 519. Thus a tablet composition might contain from 2% or 5% up to 20% or more of partially hydrated sodium acetate, accompanied by 2% or 5% to 20% by weight of crystalline sodium acetate trihydrate.

Accordingly, certain forms of the present invention provide a tablet of a compacted particulate composition wherein the tablet or a region thereof comprises from 15 to 93% by weight of a water-softening agent characterised in that the tablet or said region thereof contains 2 to 35% by weight of sodium acetate which is partially hydrated, optionally accompanied by crystallised sodium acetate trihydrate or by sodium citrate dihydrate, provided that the total quantity of sodium acetate and sodium citrate dihydrate is from 7 to 50% by weight of the tablet or said region thereof.

In another aspect, this invention provides the use of partially hydrated sodium acetate in a tablet of compacted particulate composition or a region thereof, to enhance the disintegration of the tablet in water.

This invention utilises partially hydrated sodium acetate, to promote disintegration of a tablet in water.

It is strongly preferred that the partially hydrated sodium acetate and/or mixture thereof with sodium citrate dihydrate or sodium acetate trihydrate(if any) have a mean particle size of above 250 $\mu$m, and preferably above 300 $\mu$m (0.3 mm), to facilitate flow and handling of the particulate composition prior to and during compaction. The particle size will probably have a mean value less than 2 mm, preferably less than 1 mm. Poor powder flow is disadvantageous, inter alia, in that it leads to irregular filling of dies and inconsistent tablet weight and strength.

Partially Hydrated Sodium Acetate

Two methods of obtaining partially hydrated sodium acetate will be described here.

Spray Drying

The sodium acetate solution which is spray-dried may be a heated concentrated solution of sodium acetate, which itself may be made by the direct neutralisation of acetic acid in caustic soda. The solution of sodium acetate obtained by the neutralisation of the acetic acid with caustic soda, can be readily concentrated by heating, for example by heating with steam.

The spray drying can then be carried out in a spray drying tower using a counter current of unheated and non-dried air, although the use of heated and/or dried air is also possible.

Even though such spray-drying could lead to the trihydrate of sodium acetate, it is controllable to ensure that it leads to a product which is not fully hydrated to the trihydrate. The extent of hydration (ratio of water to acetate molecules) of the sodium acetate may be higher than 2.0, or 2.5, and particularly higher than 2.6 or 2.7. The hydration is less than 3.0, and usually less than 2.9, and particularly less than 2.8.

The spray-dried sodium acetate may have a bulk density of at least 400 g/liter, preferably at least 500 g/liter, and advantageously at least 700 g/liter.

Spray-dried sodium acetate with slightly less than 3 molecules of water of hydration per acetate ion can be bought from Albright & Wilson (Product Code: 020010), and this has a hydration of 2.76, an average particle size of between 330 and 370 $\mu$m, and a bulk density of between 730 and 930 g/liter.

Direct Granulation

An alternative method of producing partially hydrated sodium acetate requires the neutralisation of acetic acid (in either its glacial form or diluted in water) by solid sodium carbonate in a mixer/granulator. The degree of hydration of the sodium acetate can be controlled by the concentration of the solution of acetic acid or by the addition of water to the mixer/granulator. The product of this granulation process may contain some sodium carbonate, but preferably no more than 10% or even less than 5%. It is possible that the resulting granules contain no sodium carbonate. Using this method can produce sodium acetate which has an extent of hydration as low as 0.5, although an extent of hydration more than 0.8, or 1.0 may be preferred. The extent of hydration may be as high as 2.0, 2.5 or 2.8.

An example of manufacture of such a material is described below. The method described above is a further aspect of the present invention, i.e. a method of making a granule containing partially hydrated sodium acetate, including the steps of neutralising acetic acid with solid sodium carbonate, and granulating the neutralisation product.

It is preferred that partially hydrated sodium acetate for use in this invention has an extent of hydration of between 0.5 and 2.9, more preferably between 1.0 and 2.8, however obtained.

Water-softening Agent

It is particularly envisaged that this invention will be applied to tablets containing water-insoluble water softening agent, notably alkali-metal aluminosilicate. However, it could be applied in tablets containing a soluble water-softening agent such as a condensed phosphate. It could be applied in tablets containing both soluble and insoluble water softening agents—as might be used in countries where a restricted quantity of phosphate detergency builder is permitted.

It is very well known that water-insoluble alkali metal aluminosilicates can function to soften water, removing calcium ions and to a lesser extent magnesium ions by ion exchange. Aluminosilicates have become strongly favoured as environmentally acceptable detergency builders.

Alkali metal (preferably sodium) aluminosilicates used in tablets of the present invention may be either crystalline, amorphous or a mixture of the two. Such aluminosilicates generally have a calcium ion exchange capacity of at least 50 mg CaO per gram of aluminosilicate, comply with a general formula:

$$0.8\text{–}1.5Na_2O.Al_2O_3.0.8\text{–}6SiO_2$$

and incorporate some water. Preferred sodium aluminosilicates within the above formula contain 1.5–3.5 $SiO_2$ units. Both amorphous and crystalline aluminosilicates can be prepared by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, and mixtures thereof. Also of interest is the novel zeolite P described and claimed in EP 384070 (Unilever).

Another category of water-insoluble material which can function as a water-softening agent and detergency builder is the layered sodium silicate builders disclosed in U.S. Pat. Nos. 4,464,839 and 4,820,439 and also referred to in EP-A-551375.

These materials are defined in U.S. Pat. No. 4,820,439 as being crystalline layered sodium silicate of the general formula $$NaMSi_xO_{2x+1}.YH_2$$

where M denotes sodium or hydrogen, and x is from 1.9 to 4 and Y is from 0 to 20.

Quoted literature references describing the preparation of such materials include Glastechn. Ber. 37, 194–200 (1964), Zeitschrift für Kristallogr. 129, 396–404 (1969), Bull. Soc. Franc. Min. Crist., 95, 371–382 (1972) and Amer. Mineral, 62, 763–771 (1977). These materials also function to remove calcium and magnesium ions from water.

It is customary to use a water-soluble builder (water-softening agent) jointly with aluminosilicate, to enhance water-softening efficacy. Such water-soluble co-builders are generally used in an amount which is not greater than the amount of aluminosilicate, often less than half the amount of aluminosilicate. Water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Especially preferred supplementary builders are polycarboxylate polymers, more especially polyacrylates and acrylic/maleic copolymers, and monomeric polycarboxylates, more especially citric acid and its salts.

If a tablet contains only soluble water-softening agent, this may well be sodium tripolyphosphate, which is widely used as a detergency builder in some countries.

When using aluminosilicate or other insoluble detergency builder/water-softening agent it is often a commercial or legislative requirement to avoid phosphates. Some tablet compositions of the invention do not contain more than 5 wt % of inorganic phosphate builders, and are desirably substantially free of phosphate builders. However, tableted compositions containing some phosphate builder are also within the broad scope of the invention. In particular, a tablet or region thereof may contain at least 15 wt % insoluble water softening agent, with phosphate or other water-soluble builder in addition.

Polymer Binder

Tablets of this invention may include an organic water-soluble polymer, applied as a coating to some of the constituent particles, and serving as a binder when the particles are compacted into tablets. This polymer may be a polycarboxylate included as a supplementary builder, as mentioned earlier.

It is preferred that such a binder material, if present, should melt at a temperature of at least 35° C., better 40° C.

or above, which is above ambient temperatures in many temperate countries. For use in hotter countries it will be preferable that the melting temperature is somewhat above 40° C., so as to be above the ambient temperature.

For convenience the melting temperature of the binder material should be below 80° C.

Preferred binder materials are synthetic organic polymers of appropriate melting temperature, especially polyethylene glycol. Polyethylene glycol of average molecular weight 1500 (PEG 1500) melts at 45° C. and has proved suitable. Polyethylene glycol of higher molecular weight, notably 4000 or 6000, can also be used.

Other possibilities are polyvinylpyrrolidone, and polyacrylates and water-soluble acrylate copolymers.

The binder may suitably be applied to the particles by spraying, e.g. as a solution or dispersion. If used, the binder is preferably used in an amount within the range from 0.1 to 10% by weight of the tablet composition, more preferably the amount is at least 1% or even at least 3% by weight of the tablets. Preferably the amount is not over 8% or even 6% by weight unless the binder serves some other additional function.

Tablets may include other ingredients which aid tableting. Tablet lubricants include calcium, magnesium and zinc soaps (especially stearates), talc, glyceryl behapate, sugar Myvatex (Trade Mark) TL ex Eastman Kodak, polyethylene glycols, and colloidal silicas (for example, Alusil (Trade Mark) ex Crosfield Chemicals Ltd).

As mentioned above, compositions of this invention may be embodied as detergent compositions for use in fabric washing, in which case the composition will generally contain from 15 to 60% by weight of detergency builder, notably water-insoluble aluminosilicate, together with preferably 7 to 50% by weight of one or more detergent-active compounds. Such a composition may well contain from 0.5 to 15% by weight of a supplementary builder, notably polycarboxylate, and also other detergency ingredients.

Another possibility is that the invention may be embodied in tablets whose principal or sole function is that of removing water hardness. In such tablets the water-softening agents, especially water-insoluble aluminosilicate, may provide from 50 to 98% of the tablet composition. A water-soluble supplementary builder may well be included, for instance in an amount from 2% to 30 wt % of the composition.

Water-softening tablets embodying this invention may include some detergent active. Notably, water-softening tablets may include nonionic surfactant which can act as a lubricant during tablet manufacture and as a low foaming detergent during use. The amount may be small, e.g. from 0.2 or 0.5% by weight of the composition up to 3% or 5% by weight.

Detergent Tablets

Tablets for use in fabric washing will generally contain from 5% to 50% by weight of detergent active, preferably from 5% or 9 wt % up to 40% or 50 wt %. Detergent-active material present may be anionic (soap or non-soap), cationic, zwitterionic, amphoteric, nonionic or any combination of these.

Anionic detergent-active compounds may be present in an amount of from 0.5 to 40 wt %, preferably from 2% or 4% to 30% or 40 wt %.

Synthetic (i.e. non-soap) anionic surfactants are well known to those skilled in the art. Examples include alkylbenzene sulphonates (LAS), particularly sodium linear alkylbenzene sulphonates having an alkyl chain length of $C_8$–$C_{15}$; olefin sulphonates; alkane sulphonates; dialkyl sulphosuccinates; and fatty acid ester sulphonates.

Primary alkyl sulphate (PAS) having the formula $$ROSO_3^-M^+$$

in which R is an alkyl or alkenyl chain of 8 to 18 carbon atoms especially 10 to 14 carbon atoms and $M^+$ is a solubilising cation, is commercially significant as an anionic detergent active. It is frequently the desired anionic detergent and may provide 75 to 100% of any anionic non-soap detergent in the composition.

In some forms of this invention the amount of non-soap anionic detergent lies in a range from 0.5 to 15 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide.

Specific nonionic detergent compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine. Other nonionic detergent compounds include alkylpolyglycosides, long-chain amine oxides, tertiary phosphine oxides, and dialkyl sulphoxides.

Especially preferred are the primary and secondary alcohol ethoxylates, especially the $C_{9-11}$ and $C_{12-15}$ primary and secondary alcohols ethoxylated with an average of from 5 to 20 moles of ethylene oxide per mole of alcohol.

In certain forms of this invention the amount of nonionic detergent lies in a range from 2 to 40%, better from at least 4 or 5% up to 25 or 30% by weight of the composition.

Many nonionic detergent-active compounds are liquids. These may be absorbed on a porous carrier. Preferred carriers include zeolite; zeolite granuled with other materials, for example Wessalith CS (Trade Mark), Wessalith CD (Trade Mark) or Vegabond GB (Trade Mark); sodium perborate monohydrate; Burkeite (spray-dried sodium carbonate and sodium sulphate as disclosed in EP-A-221776 of Unilever); and layered sodium silicate as described in U.S. Pat. No. 4,664,839.

Bleach System

Tableted detergent compositions according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. Nos. 4,751,015 and 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

As indicated above, if a bleach is present and is a water-soluble inorganic peroxygen bleach, the amount may well be from 10% to 25% by weight of the composition.

Other Ingredients

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if the detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

It may also be desirable that a detergent tablet of the invention includes an amount of an alkali metal silicate, particularly sodium ortho-, meta- or preferably alkali metal silicates at levels, for example, of 0.1 to 10 wt %, may be advantageous in providing protection against the corrosion of metal parts in washing machines, besides providing some measure of building and giving processing benefits.

Further ingredients which can optionally be employed in the detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

Particle Size and Distribution

A detergent tablet of this invention, or a discrete region of such a tablet, is a matrix of compacted particles.

Preferably the particulate composition has an average particle size in the range from 200 to 2000 μm, more preferably from 250 to 1400 μm. Fine particles, smaller than 180 μm or 200 μm may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 500 g/liter, and advantageously at least 700 g/liter.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

A tablet of the invention may be either homogeneous or heterogeneous. In the present specification, the term "homogeneous" is used to mean a tablet produced by compaction of a single particulate composition, but does not imply that all the particles of that composition will necessarily be of identical composition. Indeed it is likely that the composition will contain the spray-dried partially hydrate sodium acetate as separate particles.

The term "heterogeneous" is used to mean a tablet consisting of a plurality of discrete regions, for example layers, inserts or coatings, each derived by compaction from a particulate composition and large enough to constitute from 10 to 90% of the weight of the whole table.

It is possible that the spray-dried partially hydrate sodium acetate will be contained within one or more but not all such discrete regions of a heterogeneous tablet, such as a layer or an insert. The presence of such a layer or insert could assist break up of the entire tablet when placed in water.

Preferably, the composition of the tablet or a tablet region contains particles in which detergent active is mixed with other materials, and separate particles of spray-dried partially hydrate sodium acetate, desirably having a mean particle size over 0.3 mm.

Tableting

Tableting entails compaction of a particulate composition. A variety of tableting machinery is known, and can be used. Generally it will function by stamping a quantity of the particulate composition which is confined in a die.

Tableting may be carried out at ambient temperature or at a temperature above ambient which may allow adequate strength to be achieved with less applied pressure during compaction. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

Embodiments of the present invention will now be described by way of example only.

EXAMPLE 1

40 g detergent tablets having the following formulations were prepared on a Carver hand press using a 44 mm diameter die. The tableting mixture comprised a base powder, which was made by known granulation technology and incorporated a small percentage of crystalline sodium acetate trihydrate, together with further added ingredients. The latter included an added sodium acetate component which was either crystallised sodium acetate trihydrate available from Verdugt, or spray-dried sodium acetate containing about 2.8 molecules of water per sodium acetate ion pair.

| Component | % by Weight of total composition |
|---|---|
| Base powder | |
| Na - LAS | 9.26 |
| Nonionic 3EO, branched | 1.42 |
| Nonionic 7EO, branched | 2.65 |
| Zeolite A24 (Anhydrous) | 20.71 |
| Light soda ash | 3.07 |
| Sodium acetate trihydrate | 2.65 |
| Soap | 0.72 |
| Minor ingredients | 4.12 |
| Further ingredients added to the base powder | |
| Sodium percarbonate | 15.00 |
| Soil release polymer | 1.09 |
| Fluorescer | 1.24 |
| Antifoam granules | 1.79 |
| Acrylate/Maleate co-polymer | 1.19 |
| TAED | 5.06 |
| Sodium acetate component | 23.47 |
| Organophosphonate heavy metal | 0.735 |
| Sodium disilicate | 3.18 |
| Minor ingredients | 2.645 |

The tablets were made with various magnitudes of applied compaction force.

The strength of the tablets, in their dry state as made on the press, was determined as the force, expressed in Newtons, needed to break the tablet, as measured using an Instron type universal testing instrument to apply compressive force on a diameter (i.e. perpendicular to the axis of a cylindrical tablet).

The speed of dissolution of the tablets was measured by a test procedure in which two of the tablets are placed on a plastic sieve with 2 mm mesh size which was immersed in 9 liters of demineralised water at ambient temperature of 20° C. and rotated at 200 rpm. The water conductivity was monitored over a period of 30 minutes or until it reached a constant value. The time for break up and dispersion of the tablet (Dissolution Time) was taken as the time for change in the water conductivity to reach 90% of its final magnitude. This was also confirmed by visual observation of the material remaining on the rotating sieve.

The results are set out in the following table:

| | Crystallised Sodium Acetate Trihydrate* | Spray-dried Sodium Acetate |
|---|---|---|
| Tablet Strength (N) | Dissolution Time (min.) | |
| 44 | 3.5 | 2.5 |
| 59 | 4.7 | 3.1 |
| 77 | 6.7 | 3.8 |

*comparative example

These results show that for the same tablet strength the dissolution time is considerably shorter for tablets of the present invention compared to the comparative tablets containing crystallised sodium acetate trihydrate.

EXAMPLE 2

40 g detergent tablets having the following formulations were prepared as in Example 1. The sodium acetate component was either crystallised sodium acetate trihydrate available from Verdugt, or spray-dried partially hydrated sodium acetate.

| Component | % by Weight of total composition |
|---|---|
| Base powder | |
| Na - PAS | 9.64 |
| Nonionic 7EO, branched | 5.23 |
| Zeolite A24 (Anhydrous) | 18.69 |
| Light soda ash | 2.42 |
| Sodium citrate dihydrate | 3.01 |
| Soap | 1.64 |
| Minor ingredients | 4.36 |
| Further ingredients added to the base powder | |
| Sodium percarbonate | 16.35 |
| Soil release copolymer | 1.50 |
| AA/MA 70/30 copolymer | 1.00 |
| Antifoam granules | 2.00 |
| TAED | 5.50 |
| Sodium acetate component | 25.00 |
| EDTMP Dequest 2047 | 0.36 |
| Sodium silicate | 2.00 |
| Minor ingredients | 1.29 |

The strengths and dissolution times of tablets made with various magnitudes of compaction force were tested as in example 1.

The results are set out in the following table:

| Tablet Strength | Crystallised Sodium Acetate Trihydrate* | Spray-dried Sodium Acetate |
|---|---|---|
| (N) | Dissolution Time (min.) | |
| 57 | 2.9 | — |
| 74 | 4.8 | — |
| 106 | — | 2.6 |
| 129 | — | 4.5 |

*comparative example

These results show that for comparable dissolution times, the strength of the tablets of the present invention is almost double that of the tablets containing crystallised sodium acetate trihydrate.

EXAMPLE 3

A pair of formulations very similar to those in Example 1 were prepared on a larger scale (pilot plant) and compacted into tablets with approximately the same weight and diameter as in Example 1. This was done using a Fette tableting press, with the same compaction force for each formulation. The strengths and dissolution times were:

| Crystallised Sodium Acetate Trihydrate | | Spray-dried Sodium Acetate | |
|---|---|---|---|
| Strength (N) | Dissolution Time (min) | Strength (N) | Dissolution Time (min) |
| 70.8 | 4.4 | 71.0 | 3.4 |

EXAMPLE 4

The formulations of Example 2 were compacted using a Fette tableting press, with various magnitudes of compaction force. Once again, the tablets were approximately 40 gm in weight and 44 mm in diameter. The tablet were tested as before. The results obtained are set out in the following table:

| Crystallised Sodium Acetate Trihydrate | | Spray-dried Sodium Acetate | |
|---|---|---|---|
| Strength (N) | Dissolution Time (min) | Strength (N) | Dissolution Time (min) |
| 60.3 | 3.5 | 56.2 | 2.7 |
| 74.3 | 4.8 | 74.0 | 3.3 |
| 87.5 | 6.3 | 85.7 | 4.7 |

EXAMPLE 5

In order to make a granule containing partially hydrated sodium acetate, glacial acetic acid was mixed with water in a weight ratio of 6.7:1. This liquid was then added to sodium carbonate (light soda ash) in a lab-scale mixer with a ratio of liquid:solid of 1.28:1. The tip speed of the mixer was approximately 25 m/s. Granulation took place within 12–14 seconds. The resulting granules contained 0.9% sodium carbonate and 99.1% sodium acetate with an extent of hydration of 1.0.

42.5 g detergent tablets having the following formulations were prepared on a Grasby Specac lab-scale tablet press using a 44 mm diameter die. Varying compaction pressure was used. The tableting mixture comprised a base powder, which was made with known granulation technology and incorporated a small percentage of anhydrous sodium acetate, together with further added ingredients. The latter included an added sodium acetate component which was either crystallised sodium acetate trihydrate available from Verdugt or the partially hydrated acetate granules made above.

| Component | % by Weight of total composition |
|---|---|
| Base Powder | |
| Na - LAS | 10.43 |
| Nonionic 3EO | 1.60 |
| Nonionic 7EO | 3.00 |
| Zeolite A24 (anhydrous) | 23.36 |
| Sodium carbonate (anhydrous) | 3.34 |
| Sodium acetate (anhydrous) | 1.78 |
| Soap | 0.81 |

-continued

| Component | % by Weight of total composition |
|---|---|
| Sodium carboxymethyl Cellulose | 0.32 |
| Water and minor ingredients | 5.43 |
| Further ingredients added to the base powder | |
| Sodium percarbonate | 15.00 |
| Soil release polymer | 1.09 |
| Fluorescer | 1.24 |
| Anti-foam granules | 1.79 |
| Acrylate-maleate copolymer | 1.19 |
| TAED | 5.06 |
| Sodium acetate component | 18.00 |
| Organophosphate heavy metal sequestrant | 0.73 |
| Sodium disilicate | 3.18 |
| Coloured speckles | 1.39 |
| Enzymes | 0.88 |
| Perfume | 0.38 |
| Total | 100.00 |

The strength of the tablets, in their dry state as made on the press, was determined as the force, expressed in Newtons, needed to break the tablet, as measured using a Chatillon type universal testing instrument in a direction perpendicular to the direction of compression. The desired tablet strength was 59 N although the tablets were made with two different strengths, one below and one above 59 N.

The speed of dissolution of the tablets was measured as in the other examples.

The results are set out below, and include a linear interpolation between the results to give an estimate of the dissolution time with a tablet strength of 59 N.

| Form of Acetate | $F_{max}$ (N) | Diss. Time (Mins) | $F_{max}$ (N) | Diss Time (Mins) | Diss Time (Mins) (Interpolation for $F_{max}$ = 59N) |
|---|---|---|---|---|---|
| Partially hydrated acetate | 44.1 | 1.48 | 63.4 | 1.83 | 1.76 |
| Acetate trihydrate | 43.8 | 1.80 | 62.8 | 2.10 | 2.04 |

What is claimed is:

1. A tablet of a compacted particulate composition wherein the tablet or a region thereof comprises from 15% to 93% by weight of a water-softening agent characterised in that the tablet or said region thereof contains 2% to 35% by weight of sodium acetate which is partially hydrated.

2. A tablet according to claim 1, wherein the tablet or region which contains 2% to 35% partially hydrated sodium acetate also contains sodium citrate dihydrate, such that the total quantity of partially hydrated sodium acetate and sodium citrate dihydrate is from 7% to 50% by weight of the tablet or region thereof.

3. A tablet according to claim 1, wherein the tablet or region which contains 2% to 35% partially hydrated sodium acetate also contains crystallised sodium acetate trihydrate, such that the total quantity of partially hydrated sodium acetate and crystallised sodium acetate trihydrate is from 7% to 50% by weight of the tablet or region thereof.

4. A tablet according to claim 1, wherein the tablet or said region thereof contains from 50% to 90% by weight of water-insoluble water-softening agent and from 7% to 30% by weight of said partially hydrated sodium acetate optionally together with sodium citrate dihydrate or crystallised sodium acetate trihydrate.

5. A tablet according to claim 1 wherein the tablet or said region contains from 15% to 60% by weight of water-insoluble water-softening agent together with 5% to 50% by weight of one or more detergent-active compounds and from 2% to 30% by weight of said partially hydrated sodium acetate optionally together with sodium citrate dihydrate or crystallised sodium acetate trihydrate.

6. A tablet according to claim 5 wherein the detergent-active is present in particles containing water-softening agent, and the tablet or said region thereof contains at least 13% by weight of said partially hydrated sodium acetate with mean particle size over 250 $\mu$m.

7. A tablet according to claim 1 wherein the water-softening agent is alkali metal aluminosilicate, crystalline layered silicate or a mixture thereof.

8. A tablet according to claim 7 wherein alkali metal aluminosilicate provides at least 15% by weight of the tablet or said region thereof.

9. A tablet according to claim 1 wherein the tablet or said region thereof contains from 2% to 30% by weight of water-soluble supplementary detergency builder which is a polycarboxylate.

10. A tablet according to claim 1 wherein the said partially hydrated sodium acetate has a mean particle size of over 250 $\mu$m.

11. A tablet according to claim 10 wherein the tablet or said region thereof contains at least 13% by weight of said partially hydrated sodium acetate with a mean particle size over 300 $\mu$m.

12. A tablet according to claim 1, wherein the extent of hydration of the partially hydrated sodium acetate is between 0.5 and 2.9.

13. A tablet according to claim 1, wherein the extent of hydration of the partially hydrated sodium acetate is between 1.0 and 2.8.

14. A method of enhancing the disintegration of a tablet of a compacted particulate composition wherein the tablet or region thereof comprises from 15% to 93% by weight of a water softening agent, the method comprising incorporating into the tablet from 2% to 35% by weight of sodium acetate which is partially hydrated.

* * * * *